US007008032B2

(12) United States Patent
Chekal et al.

(10) Patent No.: US 7,008,032 B2
(45) Date of Patent: Mar. 7, 2006

(54) REFRIGERATOR INCORPORATING FRENCH DOORS WITH ROTATING MULLION BAR

(75) Inventors: Raymond J. Chekal, Belle Plaine, IA (US); Richard Allan Kirchner, Apple Valley, MN (US); Jeffrey Michael O'Halloran, Cedar Rapids, IA (US); Chad Jonathan Rotter, Amana, IA (US); Greg A. Scorpil, Tipton, IA (US); Jack J. Standefer, Cedar Rapids, IA (US); David Allen Stauffer, Belle Plaine, IA (US)

(73) Assignee: Maytag Corporation, Newton, IA (US)

( * ) Notice: Subject to any disclaimer, the term of this patent is extended or adjusted under 35 U.S.C. 154(b) by 241 days.

(21) Appl. No.: 10/650,723

(22) Filed: Aug. 29, 2003

(65) Prior Publication Data

US 2005/0046319 A1 Mar. 3, 2005

(51) Int. Cl.
*E06B 7/28* (2006.01)

(52) U.S. Cl. ..... 312/405; 49/316; 49/320; 49/321

(58) Field of Classification Search ..... 312/405, 312/407, 401, 326, 329; 16/312, 316, 309; 62/440, 441, 265; 49/316, 303, 320, 321
See application file for complete search history.

(56) References Cited

U.S. PATENT DOCUMENTS

| | | | | | |
|---|---|---|---|---|---|
| 918,731 | A | * | 4/1909 | Brooks | 16/351 |
| 1,918,865 | A | | 7/1933 | Purdy | |
| 2,723,896 | A | | 11/1955 | Wurtz | |
| 3,070,852 | A | | 1/1963 | Hilliker | |
| D210,560 | S | | 3/1968 | Kennedy et al. | |
| 3,382,618 | A | | 5/1968 | Townsend | |
| 3,466,804 | A | | 9/1969 | Swaneck, Jr. | |
| 3,590,531 | A | * | 7/1971 | Childs | 49/368 |
| 4,030,161 | A | * | 6/1977 | Loikitz | 16/284 |
| 4,226,489 | A | | 10/1980 | Haag | |
| 4,288,135 | A | | 9/1981 | Buchser et al. | |
| 4,428,153 | A | * | 1/1984 | Klinger et al. | 49/366 |
| 4,711,098 | A | | 12/1987 | Kuwabara et al. | |
| 4,864,691 | A | * | 9/1989 | Gidseg et al. | 16/312 |
| 4,991,259 | A | * | 2/1991 | Finkelstein et al. | 16/312 |
| 5,349,782 | A | | 9/1994 | Yulkowski | |

(Continued)

FOREIGN PATENT DOCUMENTS

| | | |
|---|---|---|
| JP | 11-311479 | 11/1999 |

*Primary Examiner*—Janet M. Wilkens
(74) *Attorney, Agent, or Firm*—Diederiks & Whitelaw, PLC

(57) ABSTRACT

A refrigerator includes French-style doors and a rotating mullion. The rotating mullion is mounted to one of the French-style doors through first and second hinge members. Each of the first and second hinge members include first and second hinge elements having corresponding cam members. The cam members include multiple lobes and extend about hinge pins that define an axis of rotation for the mullion. The multiple lobes actually define first and second detent positions for the rotating mullion. A spring biases the first cam member against the second cam member so that the rotating mullion is positively maintained in either the first or second position. The mullion is formed from mating halves, each including a portion of an integrally formed pin element. The pin element travels within a guide element to automatically rotate the mullion between the first and second positions during use.

22 Claims, 8 Drawing Sheets

U.S. PATENT DOCUMENTS 5,411,328 A 5/1995 You
5,542,258 A 8/1996 Shim
5,694,789 A * 12/1997 Do ..... 62/441
5,966,963 A * 10/1999 Kovalaske ..... 62/441
6,220,682 B1 4/2001 Vertullo
D452,255 S 12/2001 Chai et al.

* cited by examiner

REFRIGERATOR INCORPORATING FRENCH DOORS WITH ROTATING MULLION BAR

BACKGROUND OF THE INVENTION

1. Field of the Invention

The present invention pertains to the art of refrigerators and, more particularly, to a refrigerator including first and second French-style doors, as well as a rotating mullion bar that enables independent operation of each of the first and second French-style doors.

2. Discussion of the Prior Art

In general, refrigerators having French-style doors are known. Typically, French-style doors are used in side-by-side configurations to seal fresh food and freezer compartments. With the growing popularity of bottom mount refrigerators, manufacturers are now finding it desirable to provide French-style doors for the upper fresh food compartment.

French-style doors are desirable for a number of reasons, foremost among them is weight reduction. By design, French-style doors divide an opening in half such that each French door is approximately half the weight of a conventional door. In addition, with the increased number of storage zones being employed on refrigerator doors, the use of French-style doors enhances the arrangement for storing, as well as the accessibility to a wide variety of objects. Accordingly, when used in conjunction with a fresh food compartment, the size and strength of support structure, generally required in side-by-side applications, can be reduced substantially. However, despite all of the desirable features, there exists a drawback with French-style doors in that a mullion bar, which in side-by-side configurations divides the fresh food and freezer compartments, hinders taking goods in and out of the fresh food compartment. While the mullion is not required to "divide" the compartments, French-style doors require a central sealing surface.

A stationary mullion bar fixed to the refrigerator will limit the size and shape of goods capable of being placed in the compartment, as well as the accessibility to the goods. Toward that end, manufactures have devised two solutions to confront this issue. One solution is to mount a stationary mullion on one of the two French-style doors. With this arrangement, the door with the mullion is closed first, then the second door is closed against the mullion. While effective, this design necessitates a specific order of opening and closing the French-style doors and, if not followed, could lead to the door with the mullion bar being left ajar which would allow the cool air within the compartment to leak out.

The second solution offered to date by refrigerator manufacturers utilizes a rotating or pivoting mullion that alleviates the problems associated with the stationary mullion discussed above. Like the stationary mullion, the rotating mullion is carried by one of the two French-style doors. Typically, the mullion is caused to pivot when the door is opened or closed, with the mullion pivoting about hinge elements that allow the mullion to travel between first and second positions. Most designs include a locking mechanism, either in the form of a magnetic retaining element or a separate, spring biased, lock. In any event, the locking mechanism retains the mullion in the second position when the door is open, yet releases as the door is closed to allow the mullion to rotate into the first position. While the known retaining and locking mechanisms are functional, they necessarily require additional parts and manufacturing steps which add to the cost and complexity of the overall design.

Based on the above, there still exists a need in the art for a refrigerator having French-style doors and a rotating mullion. More specifically, there exists a need in the art for a rotating mullion that integrates a locking mechanism within a hinge to reduce the number of component parts, as well as the complexity of manufacturing.

SUMMARY OF THE INVENTION

The present invention is directed to a refrigerator having French-style doors and a rotating mullion bar. In general, the refrigerator includes a cabinet shell having first and second refrigerated compartments each having a respective opening. Preferably, the French-style doors are provided to selectively seal the opening of the first refrigerated compartment. More preferably, the French-style doors are each provided with a gasket to maintain a seal between the doors and the cabinet shell.

In accordance with the most preferred form of the invention, the French-style doors constitute first and second door members. A rotating mullion is mounted to one of the first and second door members to provide a central sealing surface between the first and second door members. Most preferably, the rotating mullion is mounted to first and second hinge members which include first and second hinge elements. More specifically, the first hinge element is mounted to one of the French-style doors and the second hinge element is secured to the rotating mullion. In addition, the first hinge element includes a first cam member and a hinge pin, while the second hinge element includes a corresponding second cam member and is rotatably mounted to the hinge pin. The first and second cam members each include multiple lobes that are adapted to nest one within the other. The multiple lobes define first and second operating positions for the rotating mullion. Actually, a spring biases the first and second cams together through the hinge pin. With this arrangement, the rotating mullion can be selectively retained in each of the first and second operating positions.

In further accordance with the most preferred form of the invention, the rotating mullion includes a guide pin member. The guide pin member extends from a top portion of the mullion and rides within a guide element. As the guide pin member travels within the guide element, the rotating mullion moves between the first and second operating positions. Preferably, the rotating mullion includes first and second mating halves each defining a portion of the guide pin member extending therefrom. More preferably, a respective portion of the guide pin member is integrally formed on each of the mating halves. Finally, the rotating mullion is provided with a heating arrangement which, during operation of the refrigeration system, prevents frost and condensation from forming on the rotating mullion.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
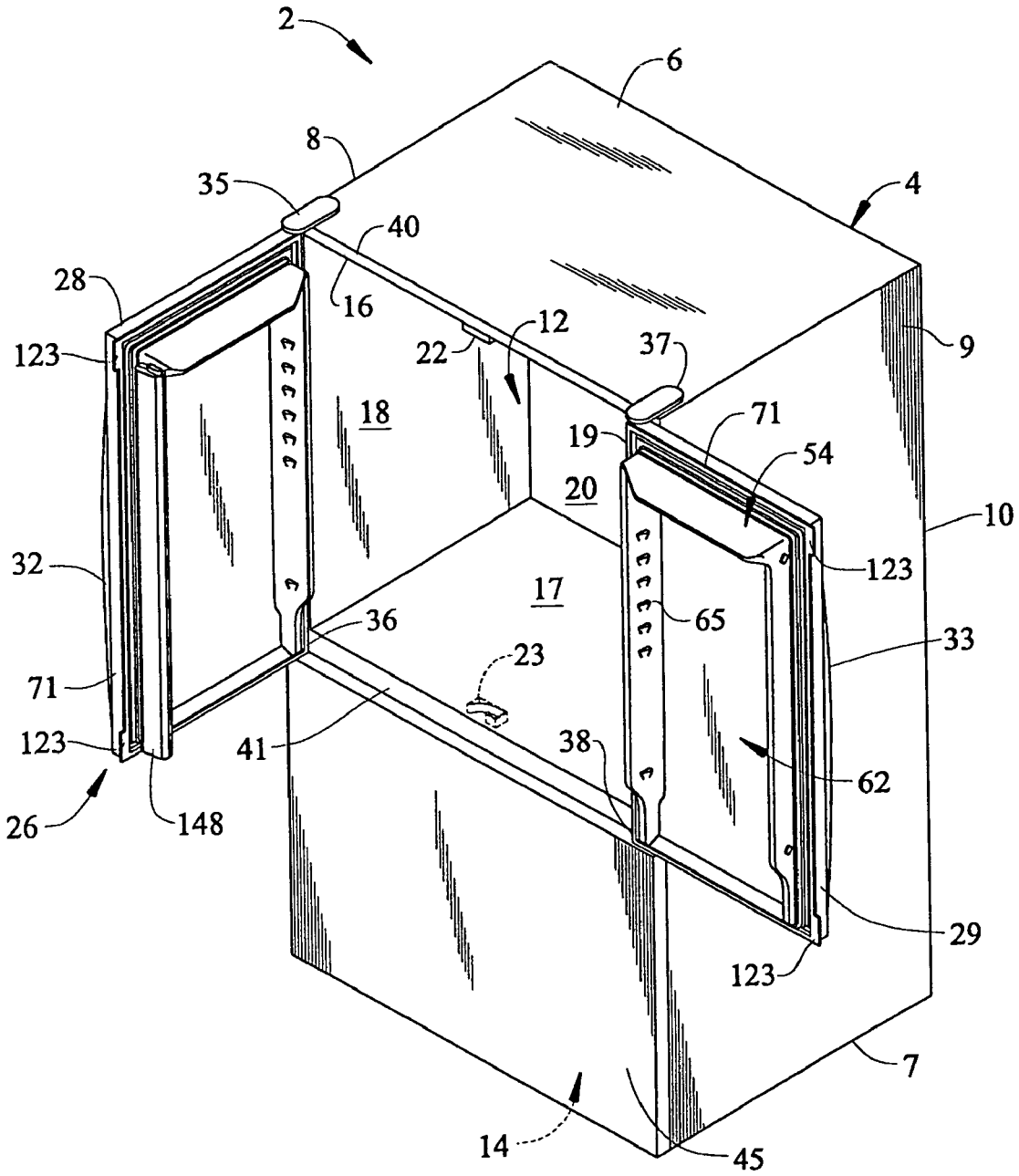
FIG. 1 is an upper right perspective view of a bottom mount refrigerator having French-style doors and a rotating mullion constructed in accordance with the present invention.
Figure 2:
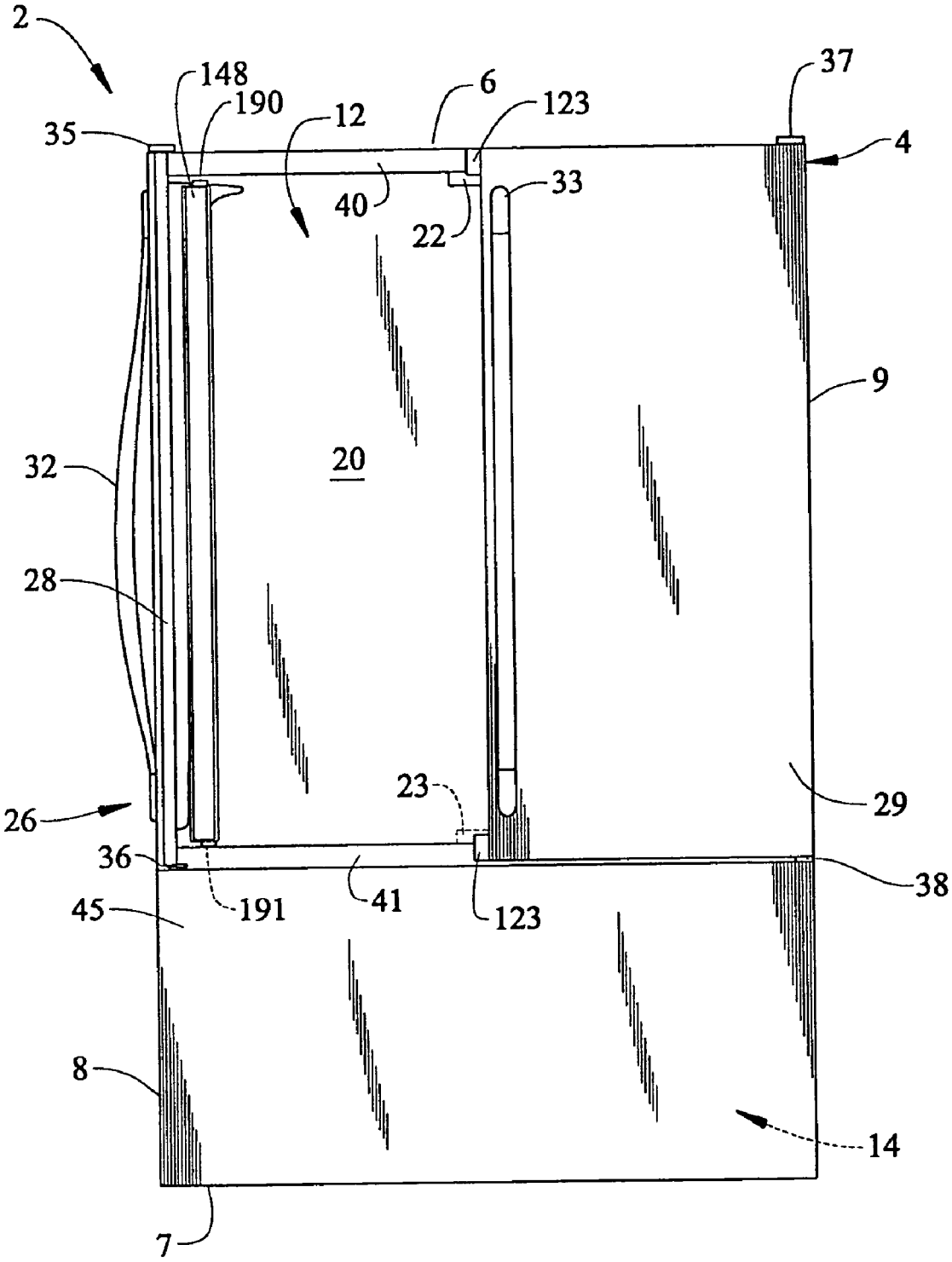
FIG. 2 is a front elevational view of the refrigerator of FIG. 1.

With initial reference to FIGS. 1 and 2, a bottom-mount refrigerator constructed in accordance with the present invention is generally indicated at 2. Refrigerator 2 is shown to include a cabinet shell 4 having a top wall 6, bottom wall 7, opposing side walls 8 and 9 and a rear wall 10 which combine to form first and second compartments 12 and 14. In the embodiment shown, first or fresh food compartment 12 includes a liner having a top portion 16, a bottom portion 17, opposing side wall portions 18 and 19 and a rear wall portion 20. In addition, a guide element 22, which will be detailed more fully below, is arranged on top portion 16. If desired, a second guide element 23 could be provided on bottom portion 17.

Refrigerator 2 is provided with an upper door assembly 26 which, in accordance with the preferred form of the invention, is constituted by French-style doors including first and second door members 28 and 29. First and second door members 28 and 29 are provided with respective handles 32 and 33 to enable a consumer to operate door members 28 and 29 providing access to fresh food compartment 12. Actually, first and second door members 28 and 29 pivot about upper and lower hinges 35 and 36, 37 and 38 respectively. As detailed more fully below, first and second doors 28 and 29 are adapted to selectively seal against upper front face portion 40 and lower front face portion 41 to prevent cold air from escaping first or fresh food compartment 12. Actually, first and second door members 28 and 29 also seal against side portions of cabinet 4 (not separately labeled). Finally, a lower or freezer door 45 is provided to enable access to the second or freezer compartment 14. In the embodiment shown, refrigerator 2 is a bottom mount configuration with lower freezer door 45 being adapted to slide in and out of cabinet 4 to provide access to frozen goods located within second compartment 14.

Figure 3:
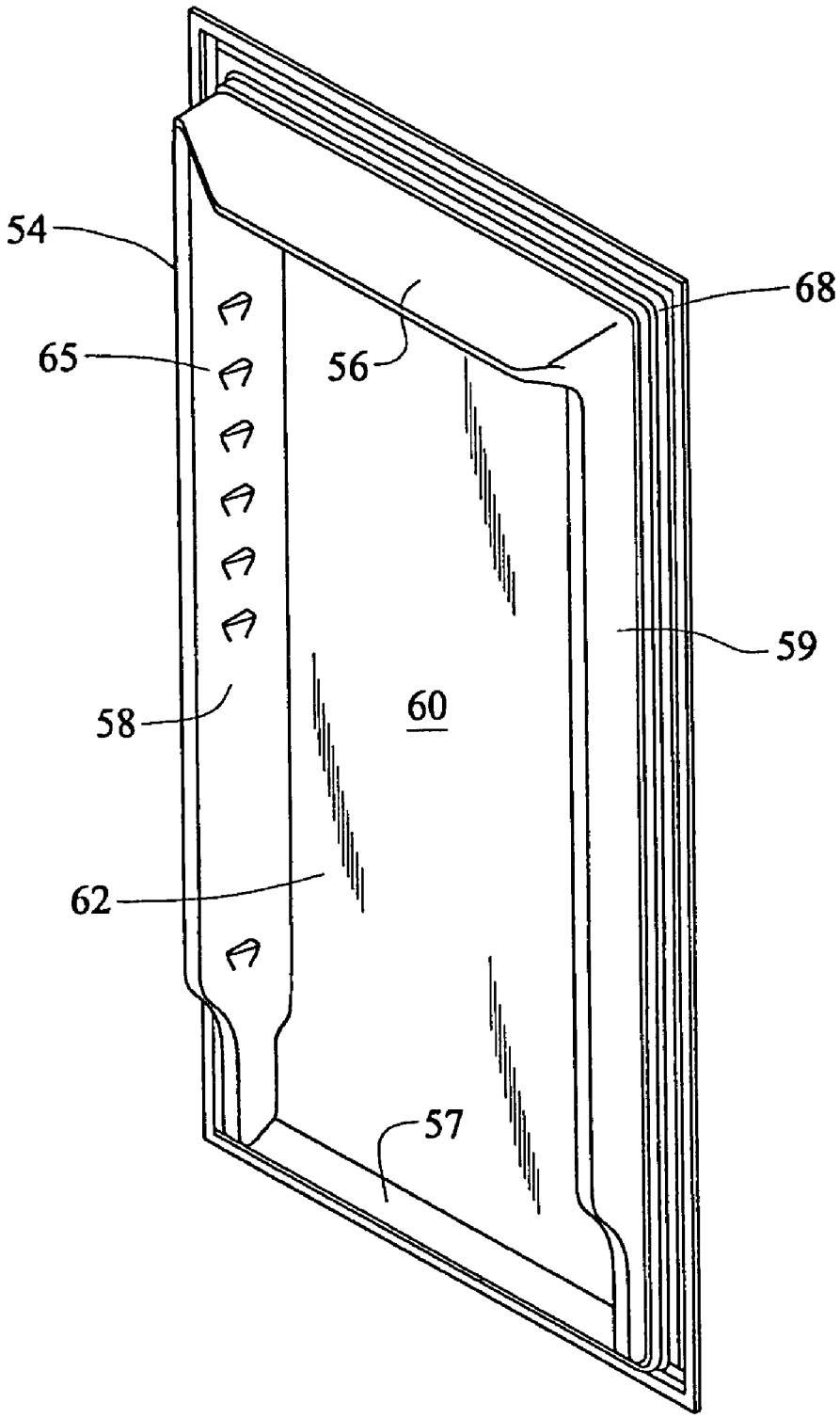
FIG. 3 is a perspective view of a door liner employed in connection with the present invention.

Reference will now be made to FIG. 3 in describing the preferred structure of a liner portion for door member 29. Actually, except as identified below, the structure of each door member 28 and 29 is identical. Therefore, a detailed description of door member 29 will be made and it is to be understood that door member 28 has commensurate structure. As shown, a liner 54 is depicted as having an outwardly projecting top portion 56, bottom portion 57, opposing side portions 58 and 59 and a rear portion 60 which collectively define a storage cavity 62. In a manner known in the art, storage cavity 62 is provided with a plurality of shelf support elements, one of which is indicated at 65 on side portion 58. However, it should be understood that a corresponding plurality of shelf support elements (not shown) are provided on opposing side portion 59. In any event, shelf support elements 65 are adapted to receive a variety of shelf members, i.e. adjustable shelves, bins, storage units and the like, for retaining goods such as butter, soda and the like on door member 29. Liner 43 is also provided with a sealing surface 68 having a flexible gasket 71 (see FIGS. 1 and 4) which is used in providing an air-tight seal for fresh food compartment 12 when door member 29 is closed. The liner for door member 28 is identically constructed to that described above.

Figure 4:
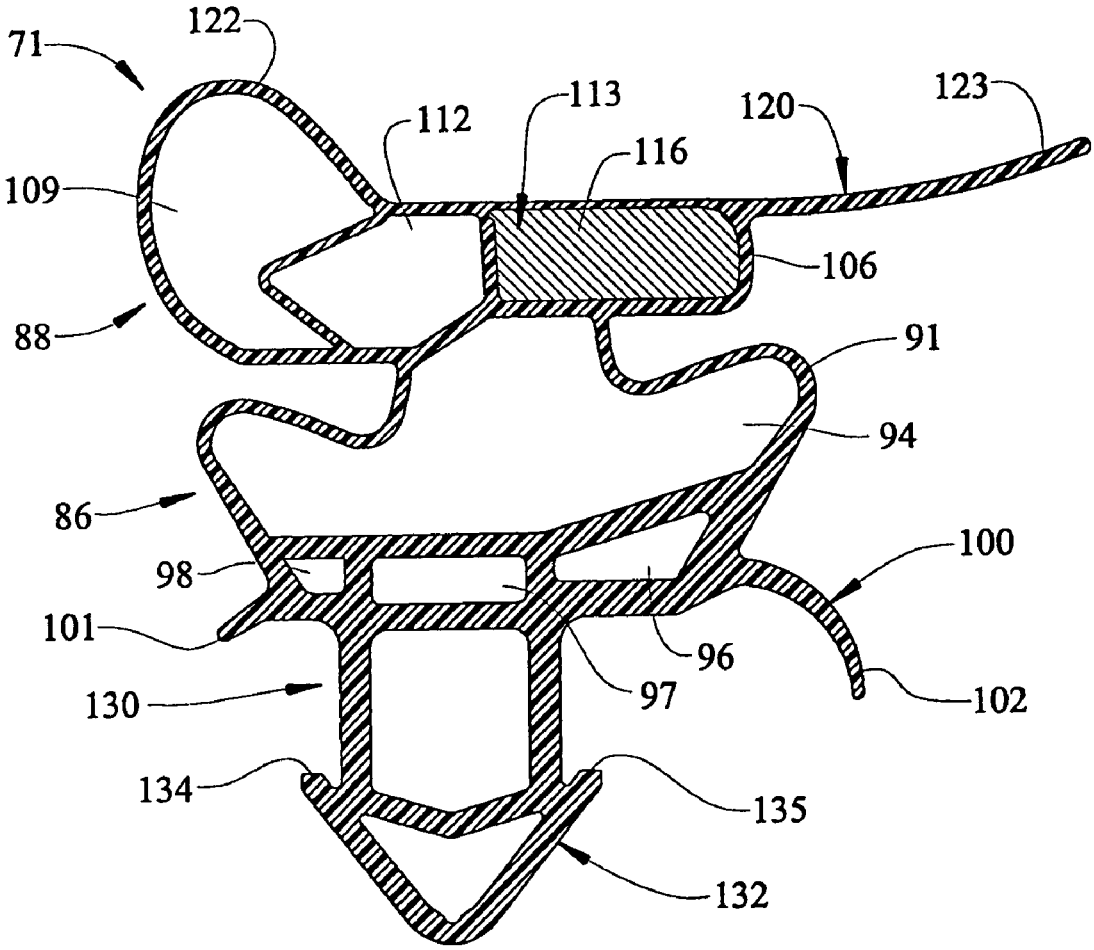
FIG. 4 is a cross-sectional view of a sealing gasket employed with the door liner of FIG. 3.

As indicated above, gaskets 71 are provided on door members 28 and 29 in order to establish an air tight seal about fresh food compartment 12 when door members 28 and 29 are closed. Referring to FIG. 4, each gasket 71 preferably includes a first or inner portion 86 interconnected with a second or outer portion 88. As shown, inner portion 86 includes a pliable, main body portion 91 which defines a plurality of cavities. More specifically, main body portion 91 defines a primary cavity 94, as well as a plurality of secondary cavities 96–98. In addition, inner portion 86 is provided with a first leg member 100 and a second leg member 101. First leg member 100 has an end 102 which, in combination with first leg member 100, forms a decorative skirt that covers an edge portion (not separately labeled) of door liner 54 and sealing surface 68 of respective ones of first and second door members 28 and 29.

In a manner similar to that described for inner portion 86, outer portion 88 includes a pliable, main body portion 106 which shares a common wall with main body portion 91. Main body portion 106 defines a primary cavity 109 and a plurality of secondary cavities 112 and 113. Actually, secondary insulation cavity 113 has provided therein a magnet 116 which is adapted to draw gasket 71 against front face portions 40 and 41 of cabinet shell 4. Additionally, outer portion 88 is provided with a second leg member 120 having a first end 122 extending to a second end or flap 123 defining a sealing surface for gasket 71. In accordance with the invention, a respective flap 123 is provided at the upper and lower inner corners of gasket 71 for both doors 28 and 29 as clearly shown in FIG. 1. When doors 28 and 29 are closed, respective flaps 123 overlap so as to reduce a flow of air from refrigerator 2 and thus limit or slow heat transfer. Finally, a projecting member 130 extends from inner portion 86 and serves to interconnect gasket 71 with sealing surface 68 of a respective one of first and second door members 28 and 29. In the embodiment shown, projecting member 130 includes a flared end 132 having an arrow-like cross section and is provided with first and second engagement surfaces 134 and 135. Actually, a plurality of projecting members 130 are provided along the length of gasket 71, with each projecting member 130 being adapted to be pressed into a respective opening or receiver (not shown) formed in liner 54 to fixedly position gasket 71 upon sealing surface 68.

Figure 5:
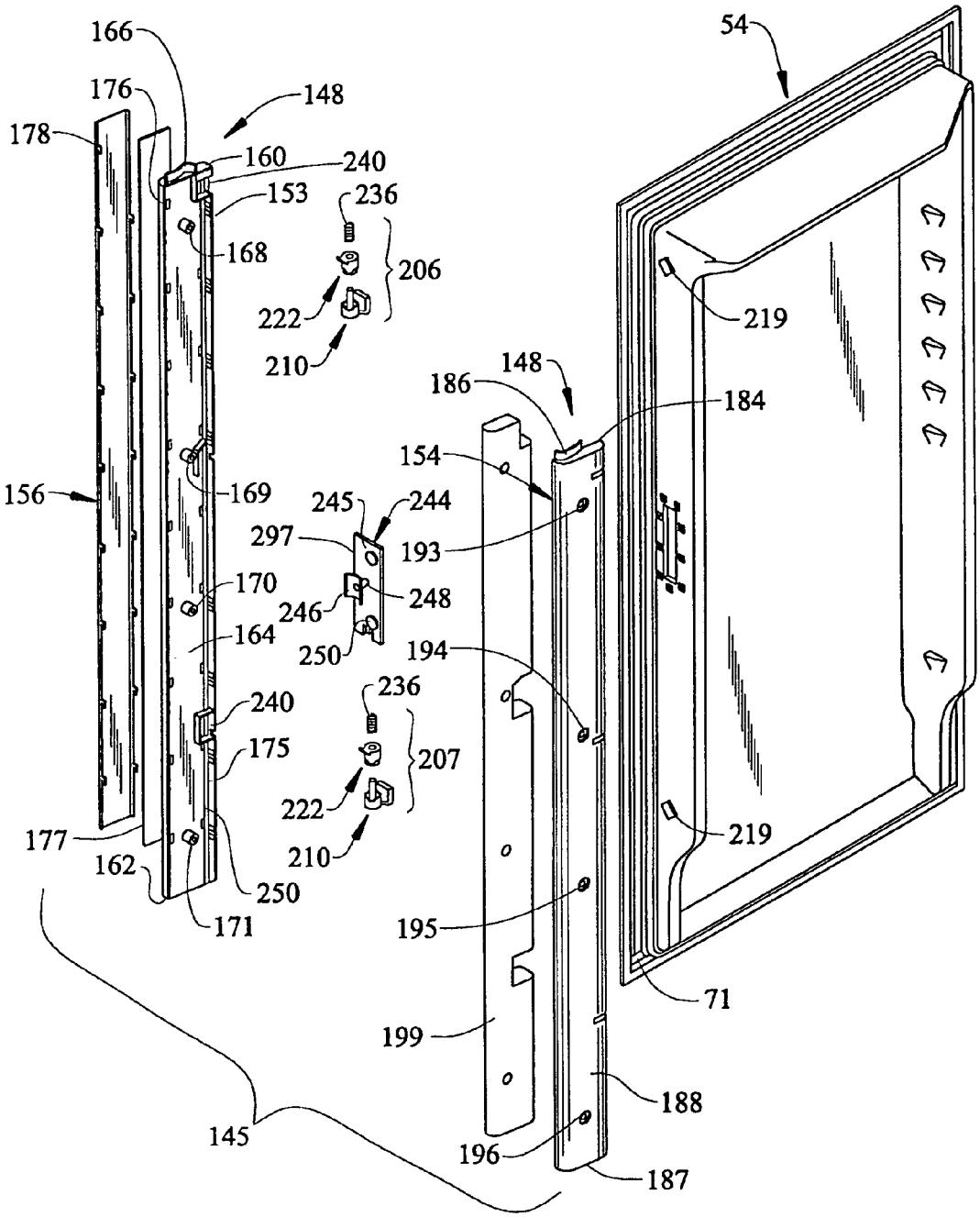
FIG. 5 is a partially exploded plan view of the door liner and rotating mullion in accordance with the present invention.
Figure 6:
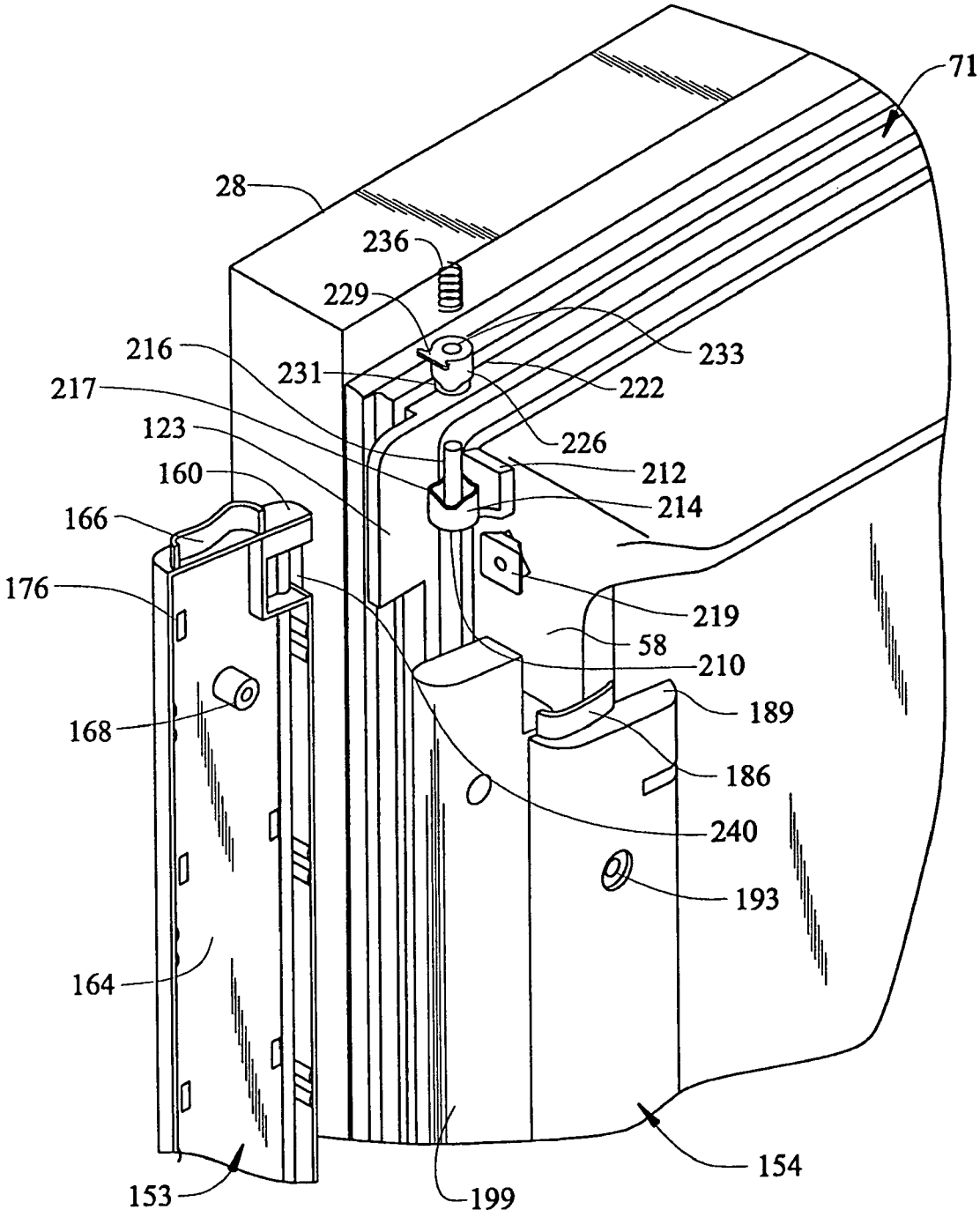
FIG. 6 is a partially exploded, perspective view of one refrigerator door, the rotating mullion, and hinge elements of the invention.

The above-described structure has been presented for the sake of completeness and to enable a better understanding of the present invention which is particularly directed to incorporating a rotating/pivoting mullion assembly, generally indicated at 145 in FIGS. 5 and 6, in refrigerator 2. As shown, mullion assembly 145 includes a mullion bar 148 having first and second mullion bar members 153 and 154, which are preferably molded of plastic, and a trim piece 156 which is made of metal to enable magnet 116 of gasket 71 to seal against trim piece 156. In the most preferred form of the present invention, first mullion bar member 153 includes a first end 160, a second end 162, and an interconnecting transverse web portion 164. First end 160 is provided with a guide pin portion 166, the details of which will be discussed more fully below. Additionally, first mullion bar member 153 is provided with a plurality of mounting lugs 168–171, and a wire channel 175 that enables passage of an electrical conductor from door 28 to a heating element 177. In accordance with the invention, heating element 177 is positioned between first mullion bar member 153 and trim piece 156. Heating element 177 prevents condensation from forming on mullion 153 and trim piece 156. Also, while heating element 188 is depicted as an electrical activator unit, a yoder tube would also be acceptable. First mullion bar 153 also includes a plurality of trim piece mounting slots, one of which is indicated at 176. Trim piece mounting slots 176 are sized to snap-fittingly receive a corresponding plurality of mounting projections 178 extending from trim piece 156.

In further accordance with the most preferred form of the present invention, second mullion bar member 154 is provided with a first end 184 having a guide pin portion 186, a second end 187, and an interconnecting transverse web portion 188. As perhaps best seen in FIG. 7, pin portions 166 and 186 combine to define a guide pin 190 which, as will be discussed more fully below, travels within upper guide element 22 mounted within fresh food compartment 12. Although not included in this preferred embodiment, it should be noted that a second guide pin 191 (see FIG. 2), similar to guide pin member 190, could be provided at second ends 162 and 187 of mullion bar 148. Second mullion bar member 154 includes a plurality of fastener receiving apertures 194–196 which, in the embodiment shown, are shaped to receive a hexagonal nut of a type known in the art. With this arrangement, a plurality of mechanical fasteners (not shown) can be inserted through the plurality of mounting lugs 168–171 to engage with nuts (also not shown) received within fastener receiving members 193–196 to join first and second mullion bar members 153 and 154 to form mullion bar 148. Of course, other connection arrangements, such as integral snap-connectors or glue, could also be employed. Finally, positioned between first and second mullion bar members 153 and 154 is an insulation strip 199. Preferably, insulating strip 199 is formed from EPS insulation, however other forms of insulation, such as blown foam, are also considered acceptable. In any event, insulation strip 199 is positioned to slow cold air conduction through mullion bar 148 and reduce sweating.

Referring to FIGS. 5 and 6, mullion bar assembly 145 further includes first and second hinge members 206 and 207 which pivotally secure mullion bar 148 to door member 28. Since the structure of each hinge member 206 and 207 is identical, a detailed description of hinge member 206 will be made and it is to be understood that hinge member 207 has commensurate structure. Hinge member 206 includes a first hinge element 210 having a base portion 212 interconnected with a first, multi-lobed cam member 214. In the embodiment shown, a hinge pin 216 projects through first multi-lobed cam member 214 and is spaced from first multi-lobed cam member 214 by an interior cavity 217. In accordance with the most preferred form of the invention, first hinge element 210 is secured to first door member 28 by sliding base portion 212 upon a dovetail clip 219 (also see FIG. 7) secured to a side portion 58 of first door member 28.

As further shown in FIGS. 5 and 6, hinge member 206 includes a second hinge element 222 which includes a second, multi-lobed cam member 226 and a mounting flange 229 adapted to interconnect with first mullion bar portion 153. Second hinge element 222 further includes a cylindrical base portion 231 adapted to be received in interior cavity 217 of first hinge element 210. Actually, second hinge element 222 includes a central bore 233 through which extends hinge pin 216 that enables first and second multi-lobed cam members 214 and 226 to nest one within the other. Finally, hinge member 206 incorporates a spring 236, preferably a coil spring, positioned above second hinge element 222 which is adapted to provide a biasing force holding second hinge element 222 against first hinge element 210 as will be further discussed below. At this point, it is only important to note that second hinge element 222 is mounted in hinge mounting recess 240 established between first and second bar portions 153 and 154, with mounting flange 229 preventing relative rotation between second hinge element 222 and mullion bar 148 while second hinge element 222 can vertically shift or translate relative to first flange element 210 within hinge mounting recess 240.

In further accordance with the most preferred form of the present invention, mullion assembly 145 includes a cover 244 having a base member 245 interconnected with a pivot member 246 through a conduit or sleeve 248 (FIG. 5). With this construction, either a control wire (not shown) can extend within first door member 28 and interconnect with heating element 177 to heat mullion bar 148 so as to prevent condensation build-up on mullion bar 148 and first and second door members 28 and 29. In addition, base member 245 is provided with a plurality of bumpers 250 that dampen the impact of mullion bar 148 on side portion 58 of liner 54 when door 28 is opened.

Having described a preferred structure of the rotating mullion bar of the present invention, reference will now be made to FIGS. 7–11, which have been presented without gasket 71 for clarity of the drawings, in describing a preferred method of operation. With initial reference to FIG. 7, mullion bar 148 is adapted to rotate about first and second hinge members 206 and 207, as well as pivot member 246 of wire cover 244. Toward that end, guide pin 190 travels through a guide path 260 provided in guide element 22 when door member 28 is opened or closed. As shown, guide path 260 includes a first sloping portion 262 extending to a substantially straight segment 264 followed by a curved portion 266 and terminating in an in-turned portion or projection 267. As further shown in FIG. 7, guide pin 190 is provided with a first cam surface 280 which is adapted to engage guide path 260 when door member 28 is closed and a second cam surface 285 which is adapted to engage projection 267 when door member 28 is opened. With this arrangement, it should be understood that door member 28 could be opened irrespective of the position of door member 29.

Figure 7:
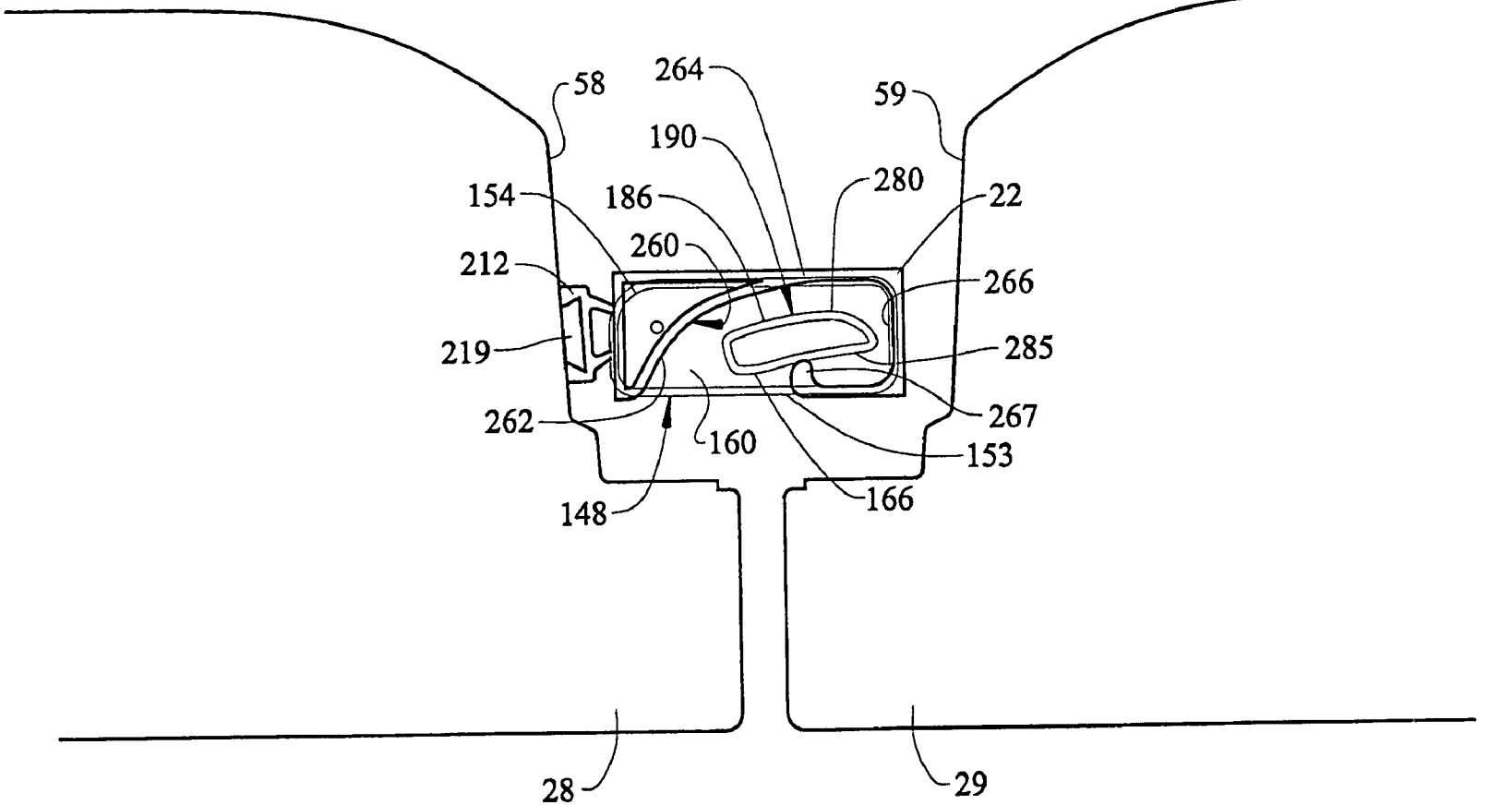
FIG. 7 is a top view of an end portion of the rotating mullion of FIG. 5 positioned within a guide element.
Figure 8:
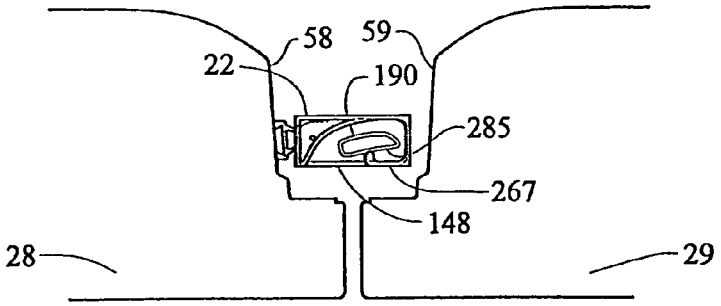
FIG. 8 is a top view of the rotating mullion and French-style doors depicted in a closed position.
Figure 9:
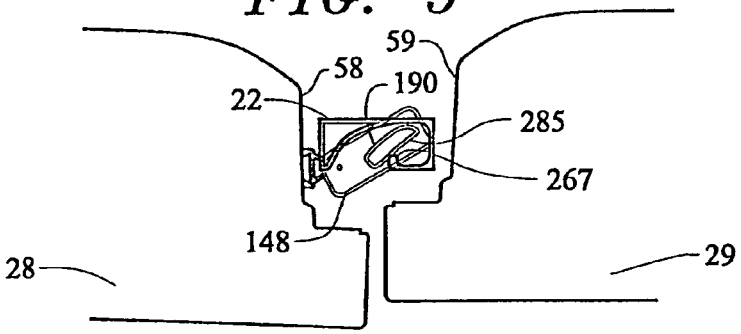
FIG. 9 is a top view of the rotating mullion of FIG. 7 moving from the closed position in FIG. 8 to an open position.
Figure 10:
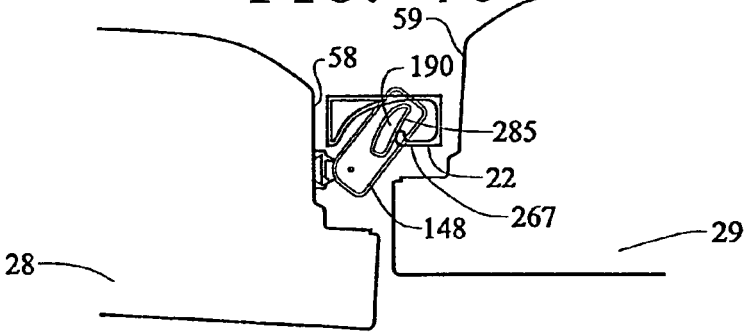
FIG. 10 is a top view of the rotating mullion and French-style doors of FIG. 9 showing the mullion continuing to travel within the guide element.
Figure 11:
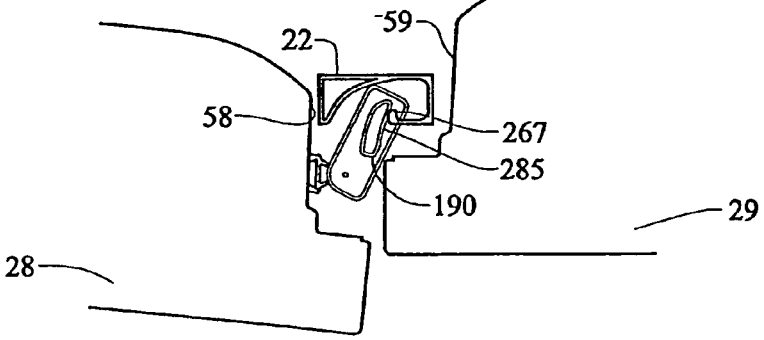
FIG. 11 is a top view of the rotating mullion and French-style doors of FIG. 9 depicting the mullion disengaging from the guide element upon further opening of the door.

In any event, when door member 28 is in a closed position as shown in FIGS. 7 and 8, second cam surface 285 of guide pin 190 rests against projection 267 of guide element 22. With initial movement of door member 28 to the position shown in FIG. 9, guide pin 190 is forced against projection 267 causing mullion bar 148 to gradually begin to rotate relative to door member 28. As door member 28 continues to open as shown in FIG. 10, second cam surface 285 of guide pin 190 begins to travel along projection 267 causing mullion bar 148 to further rotate relative to door member 28. As guide pin 190 continues further along its outward path as represented in FIG. 11, multi-lobed cam member 226 rotates and raises upward relative to multi-lobed cam member 214. As multi-lobed cam members 214 and 226 reach a high point, coil spring 236 is compressed, creating a spring force in mullion bar 148. With this particular construction, once guide element 22 190 reaches the end of second cam surface 285, mullion bar 148 snaps or is biased against side portion of door member 28 causing mullion bar 148 to reach an end point as represented in FIG. 1. In the most preferred embodiment of the invention, mullion bar 148 rotates approximately 110° between these two positions. Mullion bar 148 will remain in this position until door member 28 is closed causing first cam surface 280 to travel along guide path 260 so as to rotate mullion bar 148 to the sealed position shown in FIG. 8. With this construction, door member 28 can be opened and closed without having to operate door member 29, while still enabling gasket 71 of door member 29 to seal against mullion bar 148. In this manner, the likelihood that a door will be left ajar is reduced.

Although described with reference to a preferred embodiment of the present invention, it should be readily apparent of one of ordinary skill in the art that various changes and/or modifications can be made to the invention without departing from the spirit thereof. For instance, rotating mullion bar 148 could be mounted to either one of the French-style doors 28, 29. In addition, while the hinges for the rotating mullion are described as being mounted to the door with dovetail arrangements, a variety of other fastening means could be employed. In general, the invention is only intended to be limited to the scope of the following claims.

What is claimed is:

1. A refrigerator comprising:

a cabinet shell including a first compartment and a second compartment, each of said first and second compartments including a respective opening for receiving items to be refrigerated;

first and second French-style doors pivotally mounted to the cabinet shell about the opening of the first compartment;

first and second gaskets arranged between the first and second doors and the cabinet shell for sealing the opening of the first compartment;

at least one guide element mounted to one of upper and lower portions of the first compartment;

a mullion bar pivotally mounted to the first door, said mullion bar including first and second, interconnected members;

first and second hinge members, each of said first and second hinge members including first and second hinge elements, said first hinge element including a first cam member and a hinge pin defining a hinge axis, said second hinge element including a second cam member and a hinge pin receiver, each of said first and second hinge elements being mounted to a respective one of the first door and the mullion bar, with the hinge pin extending into the hinge pin receiver and the first and second cam members being nested together;

a spring biasing the first and second hinge elements into engagement; and at least one guide member provided on at least one of upper and lower portions of the mullion bar, said at least one guide member being adapted to engage the at least one guide element during opening and closing of the first door to cause relative rotating and translating motions between the first and second cam members against a biasing force of the spring and forced rotation of the mullion bar about the hinge axis relative to the first door.

2. A refrigerator comprising:

a cabinet shell including a first compartment and a second compartment, each of said first and second compartments including a respective opening for receiving items to be refrigerated;

first and second French-style doors pivotally mounted to the cabinet shell about the opening of the first compartment;

at least one guide element mounted to one of upper and lower portions of the first compartment;

a mullion bar pivotally mounted to the first door;

first and second hinge members, each of said first and second hinge members including first and second hinge elements, said first hinge element including a first cam member and a hinge pin defining a hinge axis, said second hinge element including a second cam member and a hinge pin receiver, each of said first and second hinge elements being mounted to a respective one of the first door and the mullion bar, with the hinge pin extending into the hinge pin receiver and the first and second cam members being nested together;

a spring biasing the first and second hinge elements into engagement; and at least one guide member provided on at least one of upper and lower portions of the mullion bar, said at least one guide member being adapted to engage the at least one guide element during opening and closing of the first door to cause relative rotating and translating motions between the first and second cam members against a biasing force of the spring and forced rotation of the mullion bar about the hinge axis relative to the first door.

3. The refrigerator according to claim 2, wherein the mullion bar includes first and second members connected together.

4. The refrigerator according to claim 3, wherein the guide member constitutes a pin element integrally molded with the mullion bar.

5. The refrigerator according to claim 3, wherein the guide member includes first and second portions, said first portion extending from the first member of the mullion bar and said second portion extending from the second member of the mullion bar.

6. The refrigerator according to claim 2, wherein the first and second cam members of the first and second hinge elements are constituted by three lobed cams establishing first and second positions for the mullion bar, said mullion bar being adapted to rotate from a first position being substantially parallel to one of the first and second doors to a second position being substantially perpendicular to one of the first and second doors.

7. The refrigerator according to claim 6, wherein the mullion bar rotates approximately 110 degrees from the first position to the second position.

8. The refrigerator according to claim 2, further comprising: a mullion bar heating element positioned to heat the mullion bar.

9. The refrigerator according to claim 8, further comprising: a cover including a base member secured to one of the first and second doors and a pivot member extending into the mullion bar, said pivot member including a central pathway for a mullion bar heating element wire.

10. The refrigerator according to claim 9, wherein the base member is provided with at least one bumper adapted to selectively cushion movement of the mullion bar.

11. The refrigerator according to claim 2, wherein the mullion bar includes a cover member, said cover member being formed from a metal material.

12. The refrigerator according to claim 2, further comprising: first and second gaskets arranged between the first and second doors and the cabinet shell for sealing the opening of the first compartment.

13. The refrigerator according to claim 12, wherein each of the first and second gaskets includes a flap, said flaps preventing a flow of air to pass from the refrigerator to the surroundings.

14. The refrigerator according to claim 13, wherein each of the first and second gaskets include two flaps, with the two flaps on the first gasket overlapping the two flaps on the second gasket when the first and second doors are closed.

15. The refrigerator according to claim 12, further comprising: first and second magnets arranged within respective portions of the first and second gaskets.

16. The refrigerator according to claim 2, wherein the refrigerator is constituted by a bottom mount refrigerator.

17. The refrigerator according to claim 2, wherein the at least one guide element includes a guide surface defining a fixed guide path for the at least one guide member as the first door is closed.

18. The refrigerator according to claim 17, wherein the at least one guide element includes a projection spaced from the guide surface, said at least one guide member abutting the projection upon the opening of the first door.

19. A refrigerator comprising:

a cabinet shell including a first compartment and a second compartment, each of said first and second compartments including a respective opening for receiving items to be refrigerated;

first and second French-style doors pivotally mounted to the cabinet shell about the opening of the first compartment;

at least one guide element mounted to one of upper and lower portions of the first compartment;

a mullion bar pivotally mounted to the first door, said mullion bar including first and second, interconnected members;

first and second hinge members, each of said first and second hinge members including first and second hinge elements, wherein the first hinge element includes a base portion, a first cam member projecting from the base portion and a hinge pin defining a hinge axis, said second hinge element including a second cam member and a hinge pin receiver, each of said first and second hinge elements being mounted to a respective one of the first door and the mullion bar, with the hinge pin extending into the hinge pin receiver and the first and second cam members being nested together; and at least one guide member provided on at least one of upper and lower portions of the mullion bar, said at least one guide member being adapted to engage the at least one guide element during opening and closing of the first door to cause forced rotation of the mullion bar about the hinge axis relative to the first door.

20. The refrigerator according to claim 19, wherein said base portion includes a dove tail element, said refrigerator further including a dove tail member mounted to the first door, said dove tail element and said dove tail member being slidingly connected to mount the first hinge member to the first door.

21. The refrigerator according to claim 19, wherein each of the first and second cam members include multiple lobes, with said multiple lobes defining at least first and second detent positions for the mullion bar.

22. The refrigerator according to claim 19, further comprising: a spring biasing the second cam member against the first cam member.

* * * * *